US009134005B2

(12) United States Patent
Chen et al.

(10) Patent No.: US 9,134,005 B2
(45) Date of Patent: Sep. 15, 2015

(54) ILLUMINATION APPARATUS

(71) Applicants: Ping-Yeng Chen, Taichung (TW); Kuo-Jui Huang, Taichung (TW)

(72) Inventors: Ping-Yeng Chen, Taichung (TW); Kuo-Jui Huang, Taichung (TW)

(73) Assignee: WINTEK CORPORATION, Taichung (TW)

( * ) Notice: Subject to any disclaimer, the term of this patent is extended or adjusted under 35 U.S.C. 154(b) by 90 days.

(21) Appl. No.: 14/135,550

(22) Filed: Dec. 19, 2013

(65) Prior Publication Data

US 2014/0177236 A1 Jun. 26, 2014

(30) Foreign Application Priority Data

Dec. 20, 2012 (TW) ..... 101148804

(51) Int. Cl.
*F21V 3/00* (2015.01)
*F21V 5/00* (2015.01)

(52) U.S. Cl.
CPC ..... *F21V 5/002* (2013.01)

(58) Field of Classification Search
CPC ..... G02B 6/0053
USPC ..... 362/311.06
See application file for complete search history.

(56) References Cited

U.S. PATENT DOCUMENTS

| | | | | |
|---|---|---|---|---|
| 3,671,101 | A * | 6/1972 | Finch | 359/546 |
| 6,752,505 | B2 * | 6/2004 | Parker et al. | 362/627 |
| 7,635,207 | B2 | 12/2009 | Engel | |
| 7,722,220 | B2 | 5/2010 | Van De Ven | |

FOREIGN PATENT DOCUMENTS

| | | |
|---|---|---|
| TW | M361592 | 7/2009 |
| TW | M375190 | 3/2010 |

* cited by examiner

*Primary Examiner* — Evan Dzierzynski
(74) *Attorney, Agent, or Firm* — Ming Chow; Sinorica, LLC

(57) ABSTRACT

An illumination apparatus including a lamp housing, a light source and a glare restraining unit is provided. The lamp housing has a light exit opening. The light source is disposed according to the light exit opening. The glare restraining unit includes a substrate and a plurality of cone microstructures disposed on the substrate. After passing the glare restraining unit, the light converges.

11 Claims, 8 Drawing Sheets

ILLUMINATION APPARATUS

CROSS-REFERENCE TO RELATED APPLICATION

This application claims the priority benefit of Taiwan application serial no. 101148804, filed on Dec. 20, 2012. The entirety of the above-mentioned patent application is hereby incorporated by reference herein and made a part of this specification.

BACKGROUND OF THE INVENTION

1. Field of the Invention

The present invention relates to a light source apparatus. More particularly, the present invention relates to an illumination apparatus.

2. Description of Related Art

Since Edison invented the lamp, the humans firstly follow their inclinations to utilize a cheap and stable illumination light, such that the industry output increases and the life of the humans is changed. Since that, the humans continually devotes to develop many kinds of light sources to meet many kinds of demands. The different illumination apparatuses are developed for being applied in many kinds of conditions in recent years. The invention of the light emitting diode (LED) realizes a light source having a smaller volume and a high luminous efficiency. Hence, the light emitting diode is already applied in many kinds of illumination apparatuses. However, the volume of the light emitting diode is smaller than a conventional lamp and a fluorescence lamp relatively, and the diverging angle of the light emitting diode is usually smaller than the diverging angles of the conventional lamp and the fluorescence lamp, too. Hence, the light emitting diode usually collocates with other optical elements to change the lighting pattern of the light emitting diode. Generally speaking, the lamp housing of the routine illumination apparatus usually has a certain extent thickness, such that the thickness of the external form of the light housing can contain the dimension of the incandescent lamp. However, when the illumination apparatus further uses the light emitting diodes to be a light source, the dimension of the external form of the light housing can be recued, because the volume of the light emitting diodes is obviously smaller than the volume of the incandescent lamp. However, as a result, although the dimension of the external form of the light housing reduced benefits to being configured in indoor space, so as to avoid the ceiling or the wall being dug to forming a deep hole for arranging the illumination apparatus. But, because the luminance of the light emitting diode is excessively high, a portion of the light which being not reflected by the light housing tends to be observed by the user around the illumination apparatus. The portion of the light is namely a glare. Generally speaking, the health of the vision of the eye is obviously damaged by the glare within 30~60 seconds. Therefore, it is a problem to be urgently solved how to develop the illumination apparatus saving electric power, having a smaller volume and emitting a low glare simultaneously.

SUMMARY OF THE INVENTION

The present invention provides an illumination apparatus being suitable for providing an illumination light having a low glare.

The present invention provides an illumination apparatus including a lamp housing, a light source and a glare restraining unit. The lamp housing has a light-emitting opening. The light source is disposed in the lamp housing and emits a light toward the light-emitting opening of the lamp housing. The glare restraining unit is disposed according to the light-emitting opening. The glare restraining unit includes a substrate and a plurality of cone microstructures disposed on the substrate. The light converges after passing the glare restraining unit.

In one embodiment of the present invention, the included angle between the inclined surface and the bottom surface of each of the cone microstructures is between 35 degrees and 55 degrees.

In one embodiment of the present invention, the included angle between the inclined surface and the bottom surface of each of the cone microstructures is between 40 degrees and 50 degrees.

In one embodiment of the present invention, the cone microstructures are arranged in a (m×n) matrix.

In one embodiment of the present invention, the cone microstructures are arranged in a plurality of rows, each of the cone microstructures arranged in even rows is aligned to each other in a column direction, each of the cone microstructures arranged in odd rows is aligned to each other in the column direction, and each of the cone microstructures arranged in the even rows and each of the cone microstructures arranged in the odd rows are not aligned.

In one embodiment of the present invention, a diameter of a bottom surface of each of the cone microstructures is between 10 μm and 1 mm.

In one embodiment of the present invention, a distance between a bottom surface of each of the cone microstructures and the adjacent cone microstructure is smaller than 0.5 mm.

In one embodiment of the present invention, a top of each of the cone microstructures is a tip or a rounded top portion.

In one embodiment of the present invention, a light-emitting surface of the glare restraining unit includes a center region and a peripheral region disposed outside the center region, and a density of the cone microstructures disposed in the center region is smaller than a density of the cone microstructures disposed in the peripheral region.

In one embodiment of the present invention, the illumination apparatus further includes a plurality of scattering microstructures, wherein the scattering microstructures are disposed in the center region of the light-emitting surface, and an ability of each of the scattering microstructures to converging the light is lower than an ability of each of the cone microstructures to converging the light.

In one embodiment of the present invention, an inclined surface of each of the cone microstructures disposed in the center region is a rough surface.

In view of the foregoing, in one embodiment of the present invention, the discomfort of the user easily observing the glare caused by the light excessively diverging can be avoid by the cone microstructures of the glare restraining unit converging and refracting the light.

Several exemplary embodiments accompanied with figures are described in detail below to further describe the invention in details.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF EMBODIMENTS

Figure 1:
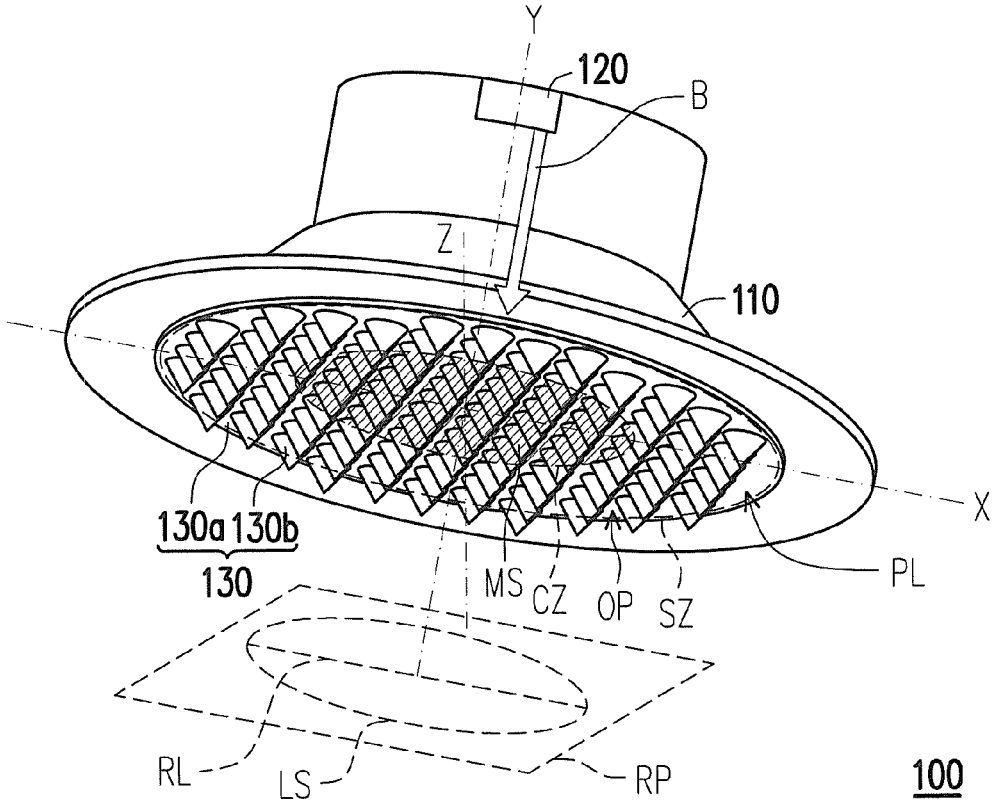
FIG. 1 is a schematic view illustrating an illumination apparatus according to one embodiment of the invention.
Figure 2:
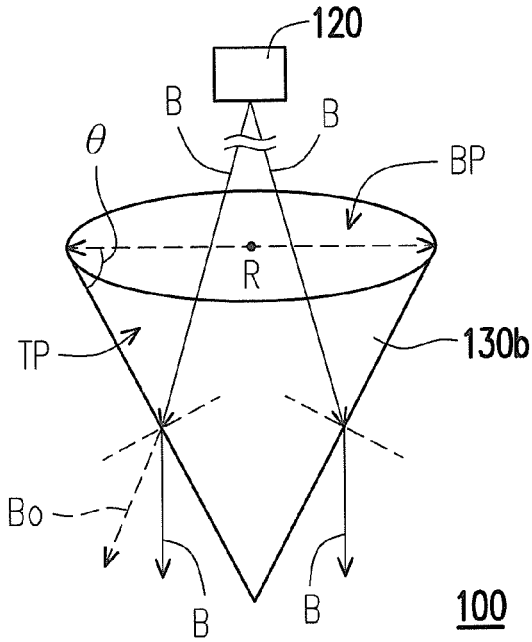
FIG. 2 illustrates a portion of the cone microstructures in FIG. 1.

FIG. 1 is a schematic view illustrating an illumination apparatus according to one embodiment of the invention. FIG. 2 illustrates a portion of the cone microstructures in FIG. 1. Referring to FIG. 1 and FIG. 2, in one embodiment of the present invention, X axis, Y axis and Z axis are took as an example to illustrate the positions of each of elements in the present embodiment. However, the present invention is not limited thereto. The illumination apparatus 100 includes a lamp housing 110, a light source 120 and a glare restraining unit 130. The lamp housing 110 has a light-emitting opening OP. The light source 120 is disposed in the lamp housing 110 and emits a light B toward the light-emitting opening OP of the lamp housing 110. The glare restraining unit 130 and the light housing 110 are assembled, so as to cover the light-emitting opening OP. The glare restraining unit 130 includes a substrate 130*a* and a plurality of cone microstructures 130*b* disposed on the substrate 130*a*. The light B converges after passing the glare restraining unit 130. For example, the light housing 110 may be a shell fabricate by plastics or metal etc. The light source 120 may be a light emitting diode or other devices suitable for radiating. As shown in FIG. 1, the glare restraining unit 130 covers the light-emitting open OP so as to reflect and converge the light B. For example, the light B may be converge in Y axis direction shown in FIG. 1, such that the light-emitting pattern of the illumination apparatus 100 can be changed, so as to reduce the glare (for example, the light that the included angle between the Y axis and the light is greater) of the illumination apparatus 100, and raise the comfort in the application.

In detail, referring to FIG. 2, in the present embodiment, the included angle θ between the inclined surface TP and the bottom surface BP of each of the cone microstructures 130*b* is between 35 degrees and 55 degrees. However, in another embodiment, the included angle θ may be between 40 degrees and 50 degrees. When the light B emitted by the light source 120 passes through the glare restraining unit 130, the light B can be reflected by each of the cone microstructures 130*b*, such that the light B is reflected to converge from the transmission path which the cone microstructures 130*b* are not disposed in (for example, the transmission path of the light $B_0$). As such, the glare of the illumination apparatus 100 can be reduced, and the comfort in the application is raised and the good light-emitting illuminance is remained at the same time.

Figure 3A:
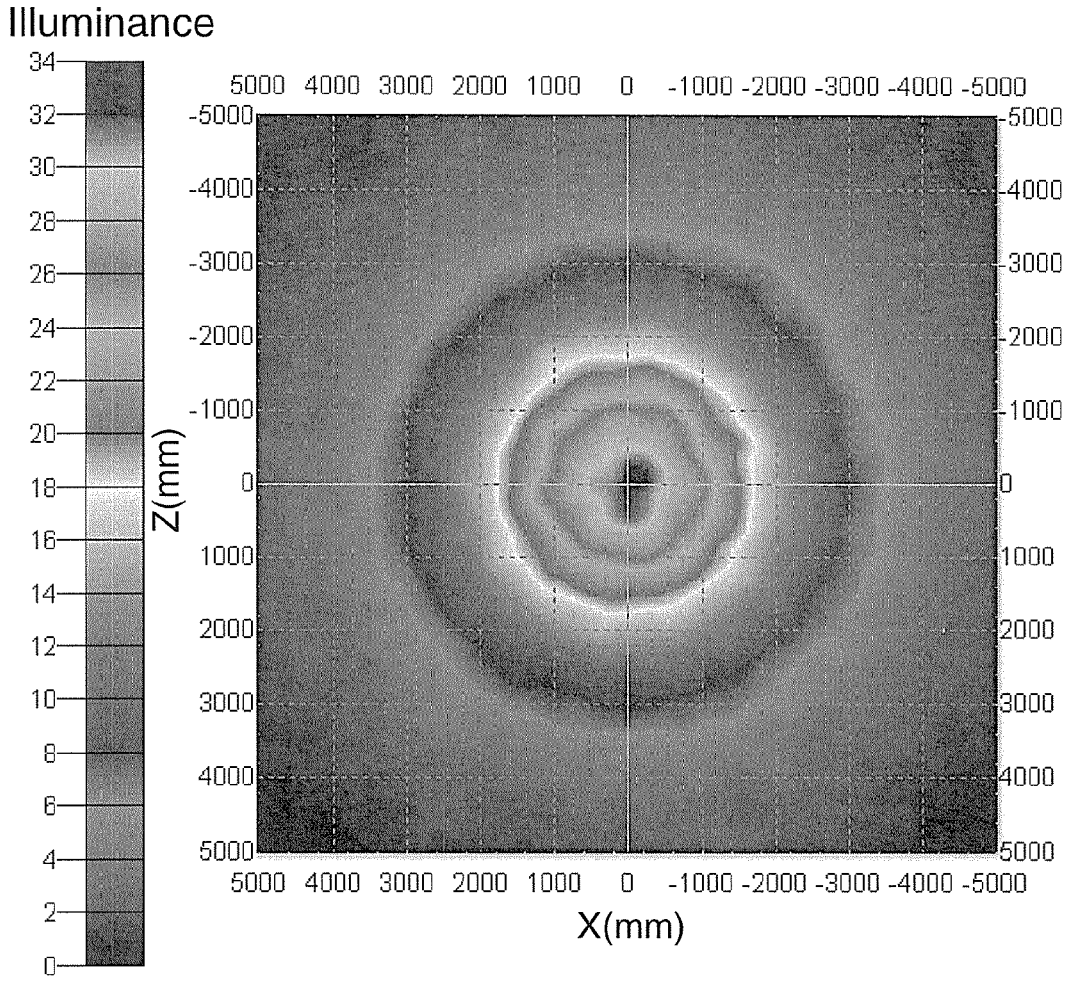
FIG. 3A is an illuminance distribution view in a reference plane of an illumination apparatus that a glare restraining unit is not disposed therein.
Figure 3B:
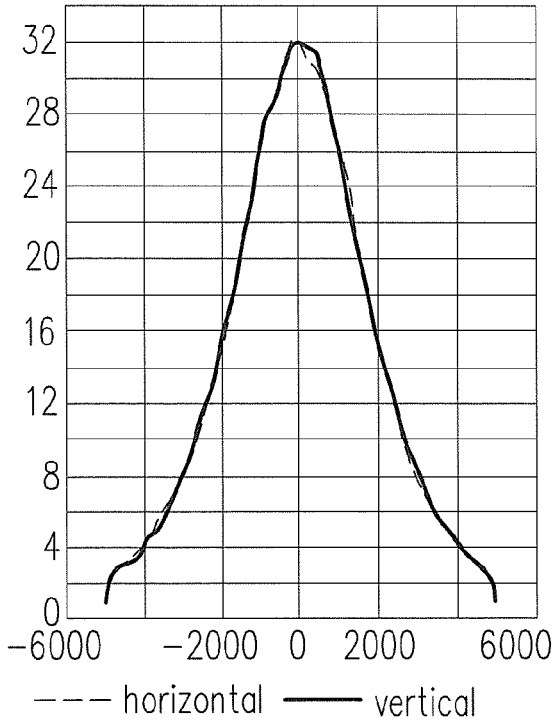
FIG. 3B is an illuminance distribution view in a reference line of a reference plane of an illumination apparatus of FIG. 3A.
Figure 3C:
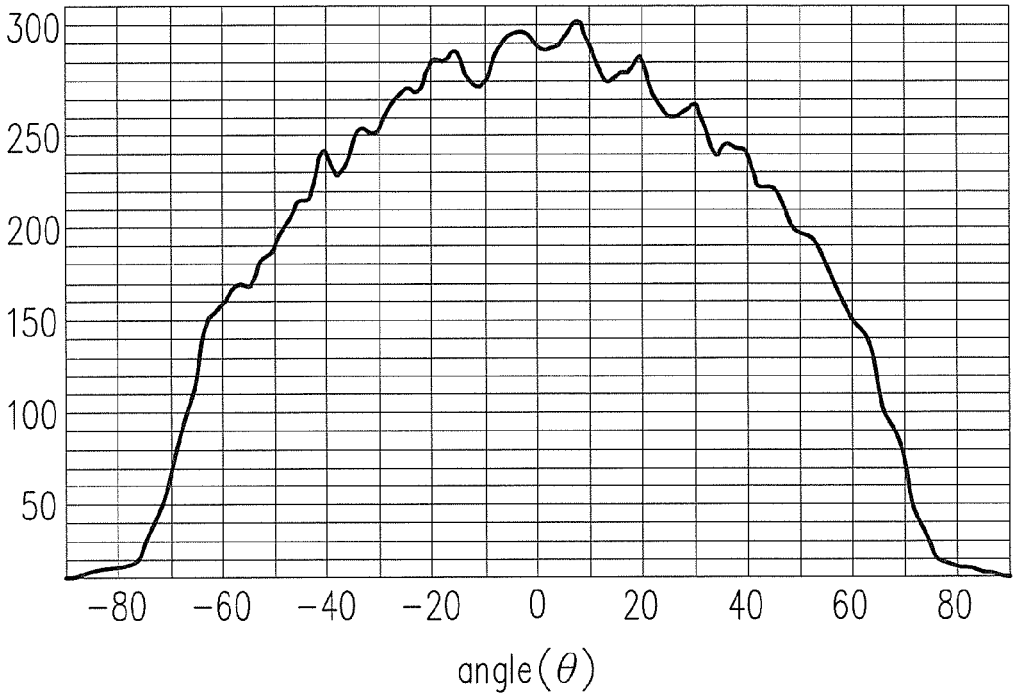
FIG. 3C is an illuminance distribution view in each of angles of one direction of an illumination apparatus of FIG. 3A.

FIG. 3A is an illuminance distribution view in a reference plane of an illumination apparatus that a glare restraining unit is not disposed therein. FIG. 3B is an illuminance distribution view in a reference line of a reference plane of an illumination apparatus of FIG. 3A. FIG. 3C is an illuminance distribution view in each of angles of one direction of an illumination apparatus of FIG. 3A. Referring to FIG. 1, FIG. 3A~FIG. 3C, it should be noted that the said reference plane RP means the plane being at 3 m from the illumination apparatus 100 and parallel to the light-emitting surface PL (for example, a plane parallel to X axis and Y axis in FIG. 1), and the reference line RL is, for example, a diameter of an illumination range LS defined by the light B projected in the reference plane RP. It is known that a light-emitting distribution of the illumination apparatus 100 that the glare restraining unit 130 is not disposed therein diverges comparatively, for example, as shown in FIG. 3C, an intensity of the light in a direction that the 50-degree included angle between the Y axis and the direction is similar to an intensity of the light in a Y axis direction. In other word, the light-emitting distribution of the illumination apparatus 100 that a glare restraining unit 130 is not disposed therein diverges, such that the glare easily generates to cause the discomfort of the user.

Figure 4:
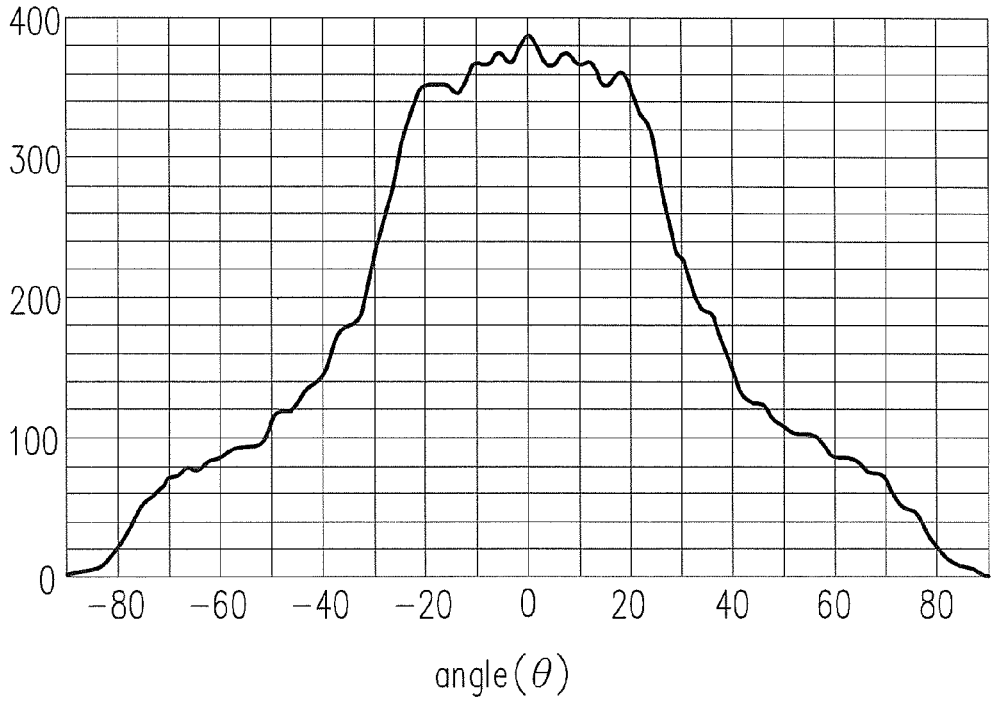
FIG. 4 is an illuminance distribution view in each of angles of one direction of an illumination apparatus that a glare restraining unit including the cone microstructures having a 55-degree included angle is disposed therein.

FIG. 4 is an illuminance distribution view in each of angles of one direction of an illumination apparatus that a glare restraining unit including the cone microstructures having a 55-degree included angle is disposed therein. Referring to FIG. 1 and FIG. 4, a light-emitting intensity shown in FIG. 4 in a direction which there is a 50-degree included angle between the Y axis and decreases obviously comparing with the light pattern distribution shown as FIG. 3C. In other word, the light-emitting light pattern of the illumination apparatus 100 can be converged well and the generation of the glare can be avoid by the cone microstructures 130*b* disposed on the glare restraining unit 130. At the same time, the light intensity of the center region of the reference plane RP still remains being similar to the light intensity of an illumination apparatus that glare restraining unit 130 is not disposed therein. Hence, the illumination apparatus 100 can provide good illuminance and raise the comfort in the application. At the same time, the light-emitting intensity in Y axis direction as shown in FIG. 4 raises about 28% comparing with the light-emitting intensity in Y axis direction as shown in FIG. 3C. In other word, the cone microstructures 130*b* disposed on the glare restraining unit 130 not only restrain the generation of the glare, but also concentrate the emitting light of the illumination apparatus 100, so as to raise the illuminance.

Figure 5:
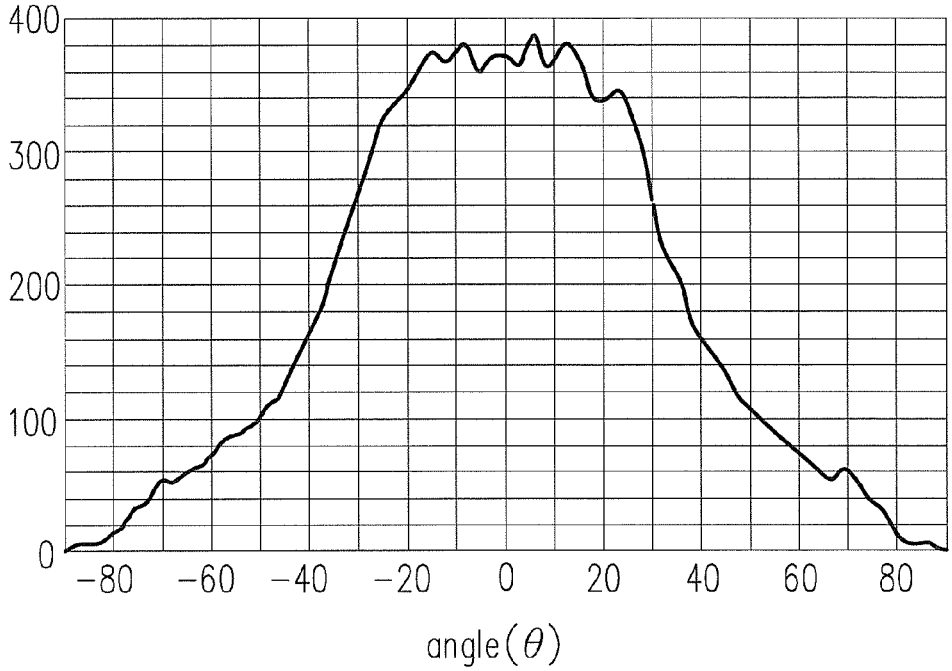
FIG. 5 is an illuminance distribution view in each of angles of one direction of an illumination apparatus that a glare restraining unit including the cone microstructures having a 50-degree included angle is disposed therein.

FIG. 5 is an illuminance distribution view in each of angles of one direction of an illumination apparatus that a glare restraining unit including the cone microstructures having a 50-degree included angle is disposed therein. Referring to FIG. 1 and FIG. 5, a light-emitting intensity shown in FIG. 5 in a direction that a 50-degree included angle between the Y axis and the direction decreases obviously comparing with the light pattern distribution shown as FIG. 3C, such that the illumination apparatus 100 can have a good function of improving the glare.

Figure 6:
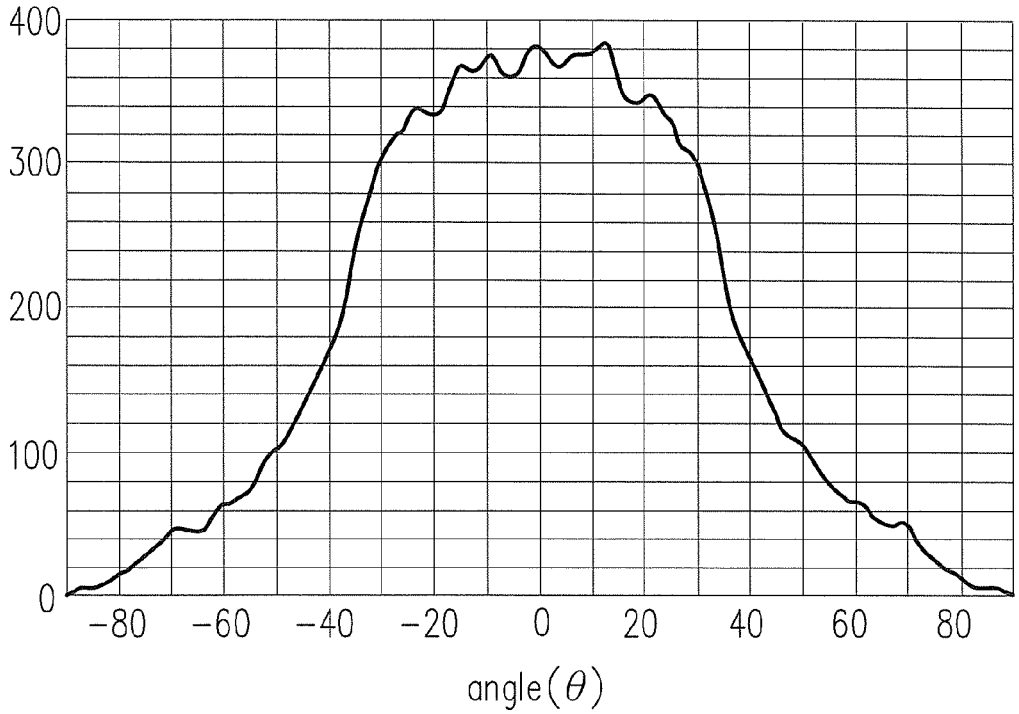
FIG. 6 is an illuminance distribution view in each of angles of one direction of an illumination apparatus that a glare restraining unit including the cone microstructures having a 45-degree included angle is disposed therein.

FIG. 6 is an illuminance distribution view in each of angles of one direction of an illumination apparatus that a glare restraining unit including the cone microstructures having a 45-degree included angle is disposed therein. Referring to FIG. 1 and FIG. 6, a light-emitting intensity shown in FIG. 5 in a direction that a 50-degree included angle between the Y axis and the direction decreases obviously comparing with the light pattern distribution shown as FIG. 3C, such that the illumination apparatus 100 can have a good function of improving the glare.

Figure 7:
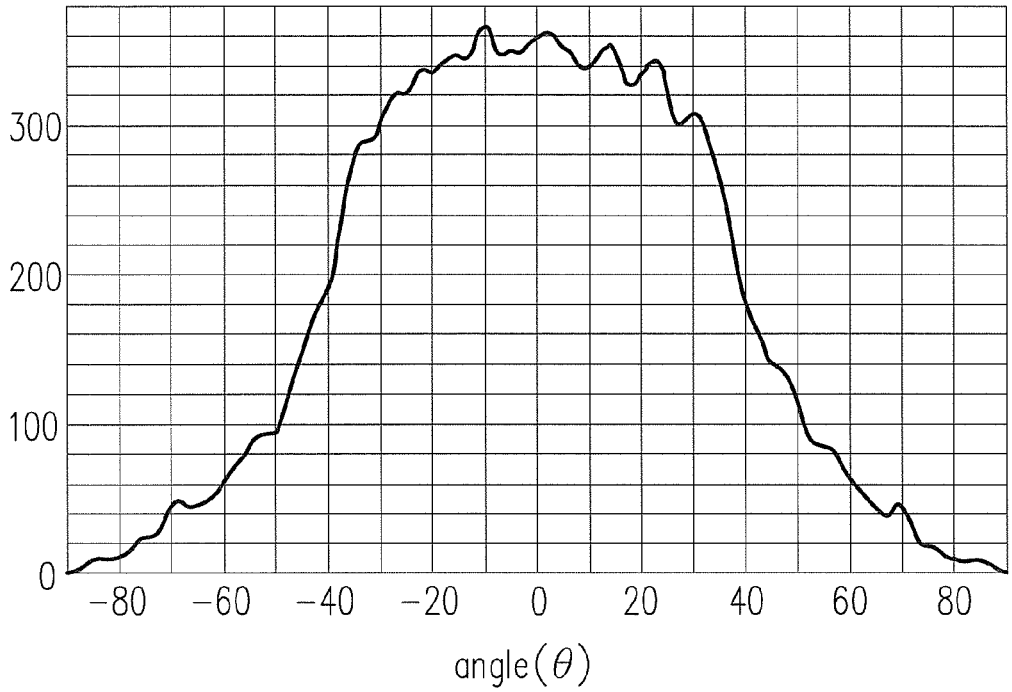
FIG. 7 is an illuminance distribution view in each of angles of one direction of an illumination apparatus that a glare restraining unit including the cone microstructures having a 40-degree included angle is disposed therein.

FIG. 7 is an illuminance distribution view in each of angles of one direction of an illumination apparatus that a glare restraining unit including the cone microstructures having a 40-degree included angle is disposed therein. Referring to FIG. 1 and FIG. 7, in the present embodiment, a light-emitting intensity shown in FIG. 7 in a direction that has a 50-degree included angle between the Y axis and the direction decreases obviously comparing with the light pattern distribution shown as FIG. 3C. The illumination apparatus 100 although has a function of improving the glare. However, when the included angle θ of the cone microstructures 130*b* is smaller and smaller, the shape of the cone microstructures 130*b* is closer and closer to a plane. Hence, the effect of the cone microstructures 130*b* upon the light-emitting pattern is smaller and smaller.

Figure 8:
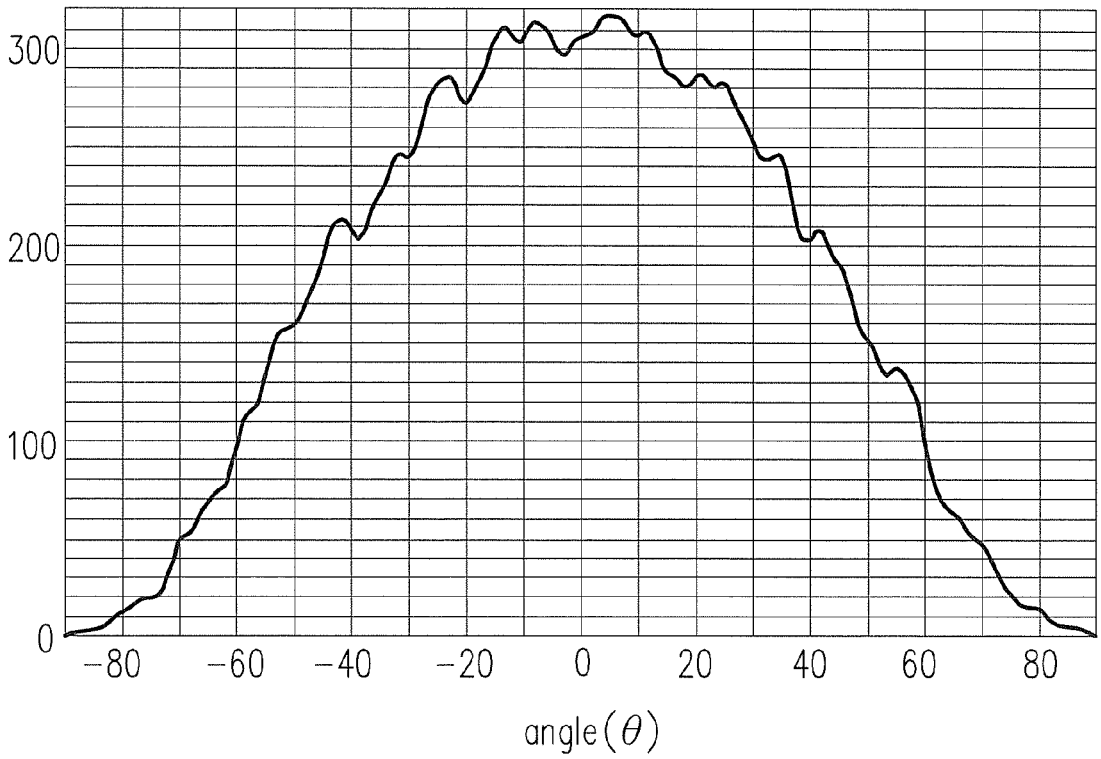
FIG. 8 is an illuminance distribution view in each of angles of one direction of an illumination apparatus that a glare restraining unit including the cone microstructures having a 35-degree included angle is disposed therein.

FIG. 8 is an illuminance distribution view in each of angles of one direction of an illumination apparatus that a glare restraining unit including the cone microstructures having a 35-degree included angle is disposed therein. Referring to FIG. 1 and FIG. 8, a light-emitting intensity shown in FIG. 8 in a direction that has a 50-degree included angle decreases, but not obviously, comparing with the light pattern distribution shown as FIG. 4~FIG. 7, because the included angle θ of the cone microstructure is small ,and the shape of the cone microstructure 130*b* is close to a plane. Hence, the effect of the cone microstructure 130*b* upon the light-emitting pattern is not great. Therefore, the light-emitting intensity distribution in FIG. 8 is close to the light-emitting intensity distribution in FIG. 3C. However, in FIG. 8, the cone microstructures 130*b* can still cause the light intensity in a direction that has a 50-degree included angle between the Y axis direction and the direction to decrease to 50% of the center intensity, and still have the function of improving the glare.

Figure 9A:
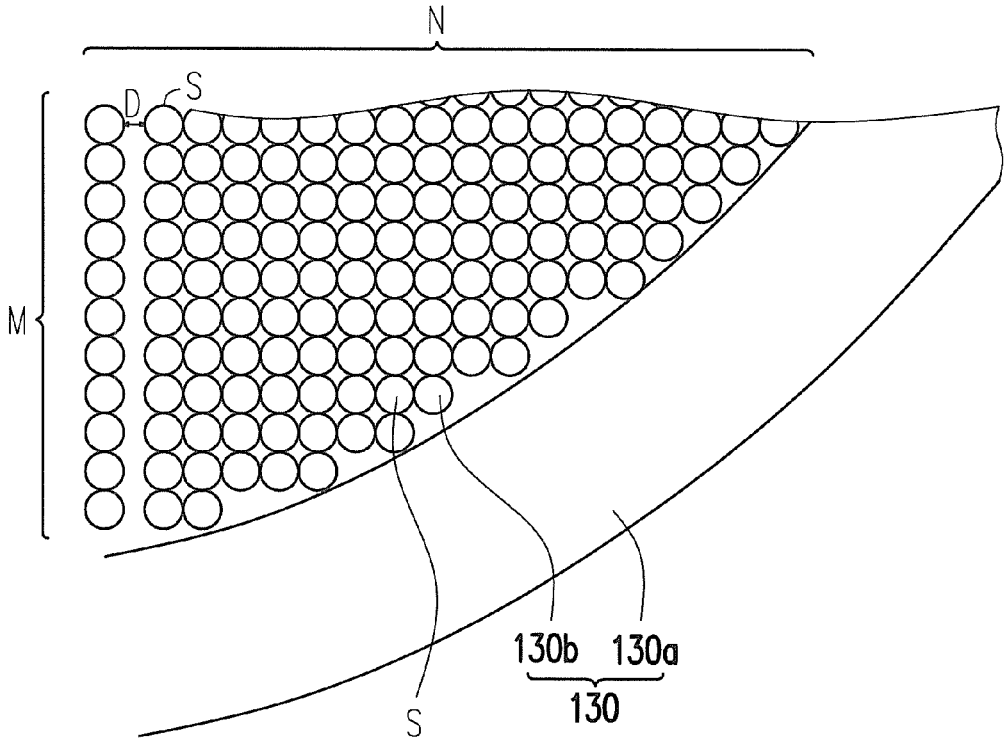
FIG. 9A is a partial enlarged view of the cone microstructures in FIG. 1.

FIG. 9A is a partial enlarged view of the cone microstructures in FIG. 1. In detail, referring to FIG. 2 and FIG. 9A, in the present embodiment, the diameter R of the bottom surface of each of the cone microstructures 130*b* is between 10 μm and 1 mm. A distance D between a bottom surface BP of each of the cone microstructures 130*b* and a bottom surface BP of the adjacent cone microstructure 130*b* is smaller than 0.5 mm. In the present embodiment, the distance D between the bottom surface BP of each of the cone microstructures 130*b* and a bottom surface BP of the adjacent cone microstructure 130*b* means the distance between a outline S of the bottom surface BP of each of the cone microstructures 130*b* and a outline S of the bottom surface BP of the adjacent cone microstructure 130*b*. For example, as shown in FIG. 9A, in one embodiment of the present invention, the said cone microstructures are arranged in a (m×n) matrix. However, the matrix as shown in FIG. 9A, for example, is a tight arrangement. In other word, the distance D between the bottom surfaces BP of each of the cone microstructures 130*b* to each other is zero, but the present invention is not limited thereto. When the distance D between the bottom surfaces BP of each of the cone microstructures 130*b* to each other is not zero, each of the cone microstructures 130*b* disposed on the glare restraining unit 130 in a unit area being arranged in a matrix having a low density also has the function of converging the light.

Referring to FIG. 1 again, in the present embodiment, a light-emitting surface PL of the glare restraining unit 130 includes a center region CZ and a peripheral region SZ disposed outside the center region CZ. The density of the distribution of the cone microstructures 130*b* can be changed in order to cause the emitting light emitted by the illumination apparatus 100 further converges in Y axis direction. For example, a density of the cone microstructures 130*b* disposed in the center region CZ is smaller than a density of the cone microstructures 130*b* disposed in the peripheral region SZ. As such, the light B passing through the glare restraining unit 130 from the center region CZ can be transmitted toward the Y axis direction along an original route, and does not tend to be influenced by the cone microstructures 130*b* having a lower distribution density comparatively. The light B passing through the glare restraining unit 130 from the peripheral region SZ can be refracted by the cone microstructures 130*b* having a higher distribution density ,such that the light-emitting pattern which diverges comparatively can be converged. As a result, the illuminance of the emitting-light can be further raised , and the generation of the glare can be also avoid at the same time.

Figure 9B:
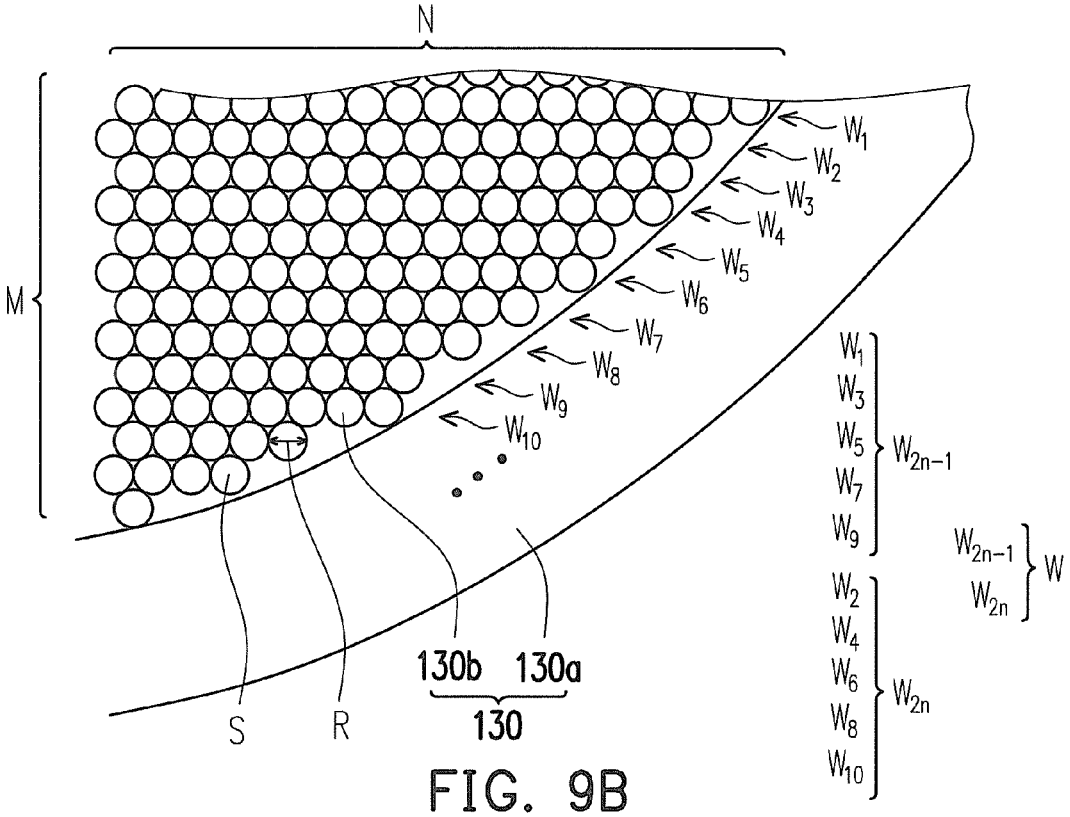
FIG. 9B is a partial enlarged view of a modified embodiment of the cone microstructures in FIG. 1.

FIG. 9B is a partial enlarged view of a modified embodiment of the cone microstructures in FIG. 1. Referring to FIG. 9B, in the present embodiment, the cone microstructures 130 may be arranged in a plurality of rows W. Each of the cone microstructures 130*b* arranged in even rows is aligned to each other in a column direction. Each of the cone microstructures 130*b* arranged in odd rows is aligned to each other in the column direction. Each of the cone microstructures 130*b* arranged in the even rows. Each of the cone microstructures 130*b* arranged in the odd rows are not aligned. For example, referring to FIG. 9B, the cone microstructures 130 disposed in the even rows $W_2$, $W_4$, $W_6$, $W_8$, $W_{10}$ is an even rows matrix $W_{2n}$. The cone microstructures 130 disposed in the odd rows $W_1$, $W_3$, $W_5$, $W_7$, $W_9$ is an odd rows matrix $W_{2n-1}$. The even rows matrix $W_{2n}$ and the odd rows matrix $W_{2n-1}$ are not align in a column direction. For example, the even rows matrix $W_{2n}$ and the odd rows matrix $W_{2n-1}$may be arranged as a honeycomb, but the present invention is not limited thereto.

Figure 9C:
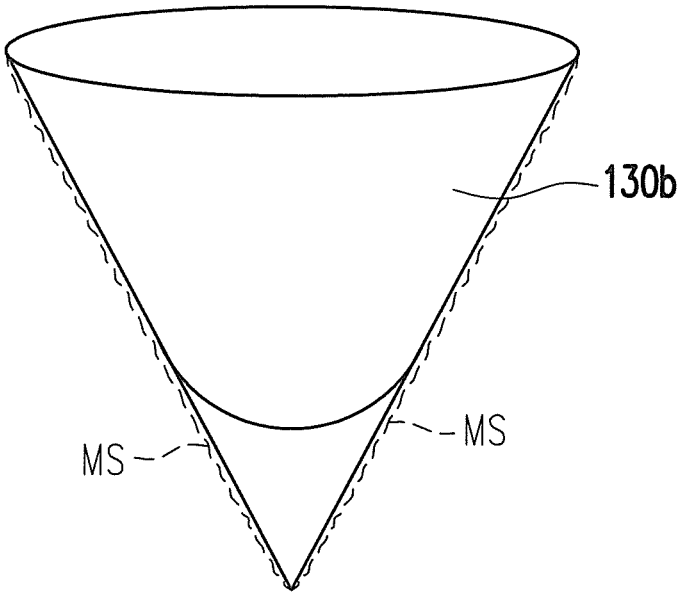
FIG. 9C is a partial enlarged view of the cone microstructures in FIG. 1.

In more detail, FIG. 9C is a partial enlarged view of the cone microstructures in FIG. 1, referring to FIG. 1 and FIG. 9C, in the present embodiment, a top of each of the cone microstructures 130*b* may be a tip (as a outline of a solid line) or a rounded top portion (as a outline of a dash line), and the cone microstructures 130*b* can still have the same function.

Moreover, referring to FIG. 1 and FIG. 9C, in the present embodiment, the illumination apparatus 100 further includes a plurality of scattering microstructures MS, wherein the scattering microstructures MS may be disposed in the center region CZ of the light-emitting surface PL, and an ability of each of the scattering microstructures MS to converging the light B is lower than an ability of each of the cone microstructures 130*b* to converging the light B. For example, the scattering microstructures MS can be a rough surface, and distribute on the inclined surface TP of the cone microstructures 130*b* or the substrate 130*a*. The scattering microstructures MS may be fabricated, for example, by sand blasting. However, the present invention is not limited thereto. As such, the scattering microstructures MS can further converge the light B so as to reduce the glare and raise the comfort in the application. However, FIG. 3A~FIG. 8 are took as an example to illustrate the present embodiment, and the present invention is not limited thereto.

To sum up, in one embodiment of the present invention, the discomfort of the user easily observing the glare caused by the light excessively diverging can be avoid by the cone microstructures of the glare restraining unit converging and refracting the light emitted by the light source. At the same time, the including angle (between the bottom surface and the inclined surface) and the distribution density of the cone microstructures can be determined by a real demand, so as to further control the distribution of light-emitting intensity for restraining the glare to result in the discomfort in the application.

It will be apparent to those skilled in the art that various modifications and variations can be made to the structure of the disclosure without departing from the scope or spirit of the invention. In view of the foregoing, it is intended that the disclosure cover modifications and variations of this invention provided they fall within the scope of the following claims and their equivalents.

What is claimed is:

1. An illumination apparatus, comprising:

a lamp housing, having a light-emitting opening;

a light source, disposed in the lamp housing and emitting a light toward the light-emitting opening of the lamp housing; and a glare restraining unit, disposed according to the light-emitting opening, wherein the glare restraining unit comprises a substrate and a plurality of cone microstructures disposed on the substrate, and the light converges after passing the glare restraining unit.

2. The illumination apparatus as claimed in claim 1, wherein an included angle between an inclined surface and a bottom surface of each of the cone microstructures is between 35 degrees and 55 degrees.

3. The illumination apparatus as claimed in claim 2, wherein the included angle between the inclined surface and the bottom surface of each of the cone microstructures is between 40 degrees and 50 degrees.

4. The illumination apparatus as claimed in claim 1, wherein the cone microstructures are arranged in a (m×n) matrix.

5. The illumination apparatus as claimed in claim 1, wherein the cone microstructures are arranged in a plurality of rows, each of the cone microstructures arranged in even rows is aligned to each other in a column direction, each of the cone microstructures arranged in odd rows is aligned to each other in the column direction, and each of the cone microstructures arranged in the even rows and each of the cone microstructures arranged in the odd rows are not aligned.

6. The illumination apparatus as claimed in claim 1, wherein a diameter of a bottom surface of each of the cone microstructures is between 10 μm and 1 mm.

7. The illumination apparatus as claimed in claim 1, wherein a distance between a bottom surface of each of the cone microstructures and the adjacent cone microstructure is smaller than 0.5 mm.

8. The illumination apparatus as claimed in claim 1, wherein a top of each of the cone microstructures is a tip or a rounded top portion.

9. The illumination apparatus as claimed in claim 1, wherein a light-emitting surface of the glare restraining unit comprises a center region and a peripheral region disposed outside the center region, and a density of the cone microstructures disposed in the center region is smaller than a density of the cone microstructures disposed in the peripheral region.

10. The illumination apparatus as claimed in claim 9, further comprising: a plurality of scattering microstructures, wherein the scattering microstructures are disposed in the center region of the light-emitting surface, and an ability of each of the scattering microstructures to converging the light is worse than an ability of each of the cone microstructures to converging the light.

11. The illumination apparatus as claimed in claim 1, wherein an inclined surface of each of the cone microstructures disposed in the center region is a rough surface.

* * * * *